US011339956B2

(12) United States Patent
Jiang

(10) Patent No.: US 11,339,956 B2
(45) Date of Patent: May 24, 2022

(54) STAGE LIGHT WITH SPEED REDUCER

(71) Applicant: Guangzhou Haoyang Electronic Co., Ltd., Guangdong (CN)

(72) Inventor: Weikai Jiang, Guangdong (CN)

(73) Assignee: Guangzhou Haoyang Electronic Co., Ltd.

( * ) Notice: Subject to any disclaimer, the term of this patent is extended or adjusted under 35 U.S.C. 154(b) by 0 days.

(21) Appl. No.: 17/272,014

(22) PCT Filed: Mar. 26, 2020

(86) PCT No.: PCT/CN2020/081499
§ 371 (c)(1),
(2) Date: Feb. 26, 2021

(87) PCT Pub. No.: WO2021/128621
PCT Pub. Date: Jul. 1, 2021

(65) Prior Publication Data

US 2021/0396377 A1 Dec. 23, 2021

(30) Foreign Application Priority Data

Dec. 24, 2019 (CN) ..... 201911344686.5

(51) Int. Cl.
*F21V 21/30* (2006.01)
*F21V 17/12* (2006.01)
(Continued)

(52) U.S. Cl.
CPC ..... *F21V 21/30* (2013.01); *F21V 17/12* (2013.01); *F21V 21/15* (2013.01); *F21W 2131/406* (2013.01)

(58) Field of Classification Search
CPC .... F21V 21/30; F21V 2131/406; F21V 14/06; F21V 14/065; F21V 14/02; F21V 14/025
See application file for complete search history.

(56) References Cited

U.S. PATENT DOCUMENTS 980,341 A * 1/1911 Roper ..... E01F 9/635 403/2
2,097,537 A * 11/1937 Snyder ..... F21V 21/30 362/426
(Continued)

FOREIGN PATENT DOCUMENTS

CN 102537885 A 7/2012
CN 202791880 U * 3/2013
(Continued)

OTHER PUBLICATIONS

Wei, Lighthouse rotary disc system, Mar. 13, 2013, CN202791880U (Year: 2013).*
(Continued)

*Primary Examiner* — Jong-Suk (James) Lee
*Assistant Examiner* — James M Endo
(74) *Attorney, Agent, or Firm* — Lerner, David, Littenberg, Krumholz & Mentlik, LLP

(57) ABSTRACT

A stage light with a speed reducer including a light head, a supporting arm and a bottom box. The light head is pivotally connected to the supporting arm by a pivot shaft. The supporting arm is pivotally connected to the bottom box by a pivot shaft. The pivot shaft of the light head and/or the pivot shaft of the supporting arm is connected to a drive shaft of a driving mechanism by the speed reducer. According to the stage light with the speed reducer, the pivot shaft of the light head and/or the pivot shaft of the supporting arm is connected to the speed reducer drive shaft of the driving mechanism, thereby realizing using a transmission part in the speed reducer for transmission, avoiding using a synchronous belt. The transmission part will not deform and cause inaccurate scanning positioning or fracture, and the product performance is more stable.

5 Claims, 3 Drawing Sheets

(51) Int. Cl.
*F21V 21/15* (2006.01)
*F21W 131/406* (2006.01)

(56) References Cited

U.S. PATENT DOCUMENTS

| | | | | | |
|---|---|---|---|---|---|
| 2,556,472 | A | * | 6/1951 | Gray | G09F 13/00 40/473 |
| 2,617,673 | A | * | 11/1952 | Sacks | F16D 1/04 403/383 |
| 4,701,833 | A | * | 10/1987 | Bornhorst | F21V 23/02 362/294 |
| 4,926,080 | A | * | 5/1990 | Koyama | F16D 1/09 310/80 |
| 2005/0047142 | A1 | * | 3/2005 | Lui | F21V 21/15 362/275 |
| 2013/0120984 | A1 | * | 5/2013 | Hinrichs | F21V 21/14 362/235 |
| 2015/0345762 | A1 | * | 12/2015 | Creasman | F21V 21/30 362/428 |
| 2016/0377256 | A1 | * | 12/2016 | Hansen | F21V 7/045 362/268 |

FOREIGN PATENT DOCUMENTS

| | | | | |
|---|---|---|---|---|
| CN | 202791880 | U | | 3/2013 |
| CN | 103486531 | A | | 1/2014 |
| CN | 104214596 | A | | 12/2014 |
| CN | 108006494 | A | * | 5/2018 |
| CN | 108826244 | A | * | 11/2018 |
| CN | 109724013 | A | | 5/2019 |
| CN | 209042065 | U | | 6/2019 |
| CN | 211203845 | U | | 8/2020 |
| JP | 2006089238 | A | | 4/2006 |

OTHER PUBLICATIONS

Wu, Multifunctional borehole operation security and protection lamp, May 8, 2018, CN108006494A (Year: 2018).*

Quan, Lifting hoisting mechanism, ceiling lamp with lifting hoisting mechanism, and ceiling range hood with lifting hoisting mechanism, Jul. 20, 2018, CN108826244A (Year: 2018).*

International Search Report for Application No. PCT/CN2020/081499, dated Sep. 30, 2020, 5 pages.

* cited by examiner

STAGE LIGHT WITH SPEED REDUCER

CROSS REFERENCE TO RELATED APPLICATIONS

The present application is a national phase entry under 35 U.S.C. § 371 of International Application No. PCT/CN2020/081499, filed Mar. 26, 2020, which claims priority from Chinese Patent Application No. 201911344686.5, filed Dec. 24, 2019, the disclosures of which are incorporated by reference herein.

TECHNICAL FIELD

The present invention relates to the technical field of stage light, and in particular, to a stage light with a speed reducer.

BACKGROUND

During the work of a stage light, it is often necessary to rotate a light head to adjust an emergent direction of a light beam. A pivot shaft driving mechanism of a light head of an existing stage light is connected to a pivot shaft for transmission through a synchronous belt, and the rotation of the light head is pulled through the synchronous belt. The synchronous belt is generally made of rubber or plastic. In such transmission process, the synchronous belt needs to play a role of subject to force in addition to the transmission function. Especially when the light is side-mounted, force to the synchronous belt is greater, which is likely to cause the synchronous belt to break. And because the synchronous belt is also elastically stretched under the force, it often causes inaccurate scanning positioning of the lamp, which affects the stability of the product.

SUMMARY

In order to overcome at least one of the above-mentioned defects in the prior art, the present invention provides a stage light with a speed reducer, so that a scanning system is more accurate, a smaller motor may be used, a space occupation is also smaller, and an effect is more stable.

In order to solve the above-mentioned technical problems, the present invention adopts the following technical solutions. A stage light with a speed reducer includes a light head, a supporting arm and a bottom box. The light head is pivotally connected to the supporting arm by a pivot shaft. The supporting arm is pivotally connected to the bottom box by a pivot shaft. The pivot shaft of the light head and/or the pivot shaft of the supporting arm is connected to the drive shaft of the driving mechanism by the speed reducer.

The pivot shaft of the light head and/or the pivot shaft of the supporting arm is connected to the drive shaft of the driving mechanism by the speed reducer, thereby realizing using a transmission part in the speed reducer for transmission, avoiding using a synchronous belt. The transmission part will not deform and cause inaccurate scanning positioning or fracture, and the product performance is more stable.

Further, the drive shaft is arranged parallel or perpendicular to the pivot shaft. It is determined according to a space size of the installation location of the speed reducer, and one can choose freely to arrange the space reasonably.

Further, the pivot shaft has a through hole for threading or circulating a cooling medium along a length direction. The speed reducer and the rotating shaft connected with the pivot shaft are provided with corresponding perforation. By providing the through hole and the perforation, it is convenient for cables and the cooling medium in the light head and/or the supporting arm to pass through, so that the light head and/or the supporting arm can be rotated smoothly.

Further, the speed reducer and the pivot shaft are connected by a coupling flange. The coupling flange can connect the ordinary rotary shaft and the ordinary pivot shaft without special design of the rotary shaft of the speed reducer and the pivot shaft, so the versatility of the components is stronger.

Further, the coupling flange includes a stationary wheel connected to the pivot shaft, and a stationary cylinder connected to the rotary shaft of the speed reducer. The stationary wheel is located at an end portion of a stationary cylinder. Since the pivot shaft is generally larger in diameter, and the rotary shaft of the speed reducer is smaller, the coupling flange is designed as a structure of the stationary wheel and the stationary cylinder, which can solve the problem of the size mismatch between the pivot shaft and the rotary shaft to smoothly connect the two.

Further, the coupling flange includes a connecting cylinder. A side wall of the connecting cylinder is provided with a first connecting hole along a length direction to be connected and fixed with the pivot shaft by screws. The side wall of the connecting cylinder is provided with a second connecting hole in a direction perpendicular to the length direction to be connected and fixed with the rotary shaft of the speed reducer by screws. When a diameter of the rotary shaft and a diameter of the pivot shaft are the same or similar, the rotary shaft and pivot shaft the can be directly connected by the connecting cylinder, and the coupling flange can be guaranteed to have a small volume.

Further, it further includes a supporting frame which supports the speed reducer. The speed reducer is installed on the supporting frame, and the supporting frame is fixed to the light head or the supporting arm to facilitate fixing the speed reducer.

Further, the speed reducer is a gear reducer. That is, the transmission parts inside the speed reducer are all gears.

Further, the pivot shaft is connected to the rotary shaft of the speed reducer as a whole body. That is, the rotary shaft of the speed reducer is directly used as the pivot shaft of the light head and/or the pivot shaft of the supporting arm, which omits the unnecessary connecting part and has a simpler structure.

Further, the driving mechanism of the light head and the driving mechanism of the supporting arm are both located in the supporting arm. The space inside the light head and the bottom box is clear to facilitate installation of other components or heat dissipation.

Further, the driving mechanism of the light head is located in the light head, and the driving mechanism of the supporting arm is located in the bottom box. The space inside the supporting arm is clear to facilitate installation of other components or heat dissipation.

100: light head; 200: supporting arm; 300: bottom box; 400: pivot shaft; 410: through hole; 500: speed reducer; 510: rotary shaft; 511: perforation; 520: supporting frame; 600: driving mechanism; 610: drive shaft; 700: coupling flange; 711: stationary wheel; 712: stationary cylinder; 713: locking hole; 720: connecting cylinder; 721: first connecting hole; 722: second connecting hole.

DETAILED DESCRIPTION

The accompanying drawings are only for illustrative purposes and cannot be construed as limitations on the present invention. In order to better illustrate the embodiment, some parts of the accompanying drawings may be omitted, enlarged or shrunk, and do not represent the size of an actual product. For those skilled in the art, it is understandable that some well-known structures and their descriptions may be omitted in the accompanying drawings. The positional relationship illustrated in the accompanying drawings is only for illustrative purposes, and cannot be understood as a restriction on this patent.

Figure 1:
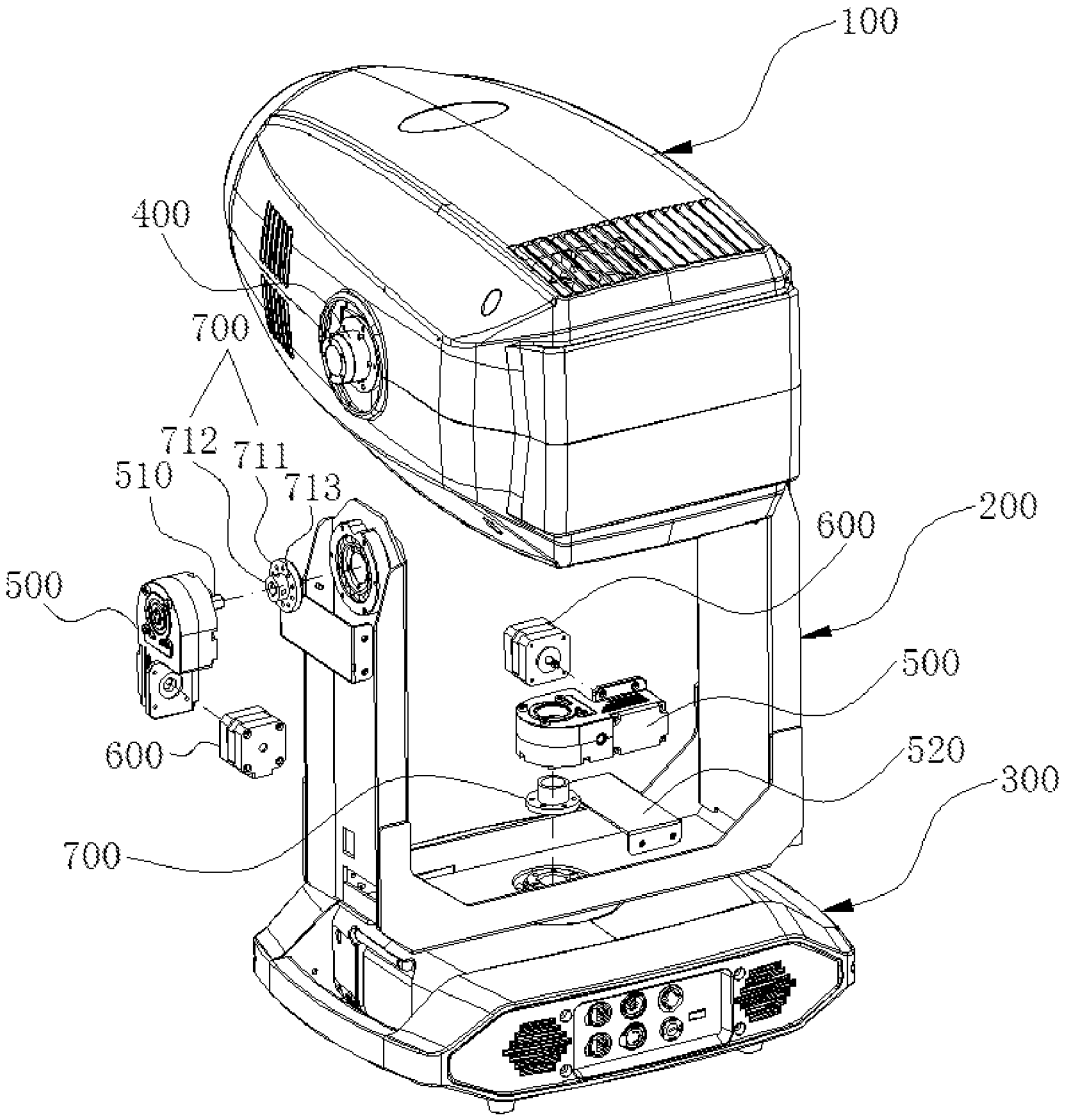
FIG. 1 is a structural schematic diagram of a stage light with a speed reducer according to the first embodiment of the present invention.

As shown in FIG. 1, the first embodiment of the present invention provides a stage light with a speed reducer (500), which includes a light head (100), a supporting arm (200) and a bottom box (300). The light head (100) is pivotally connected to the supporting arm (200) by a pivot shaft (400). The supporting arm (200) is pivotally connected to the bottom box (300) by a pivot shaft (400). The light head (100) rotates around a first direction on the supporting arm (200). The supporting arm (200) rotates to drive the light head (100) to rotate around a second direction. The pivot shaft (400) of the light head (100) and/or the pivot shaft (400) of the supporting arm (200) is connected to a drive shaft (610) of a driving mechanism (600) by the speed reducer (500). It can be that only one of the pivot shafts (400) is connected to the drive shaft (610) of the driving mechanism (600) by the speed reducer (500), or can be that the pivot shaft (400) of the light head (100) and the pivot shaft (400) of the supporting arm (200) are connected to the drive shaft (610) of the driving mechanism (600) by the speed reducer (500), to improve the rotation accuracy and stability of the light head (100) in the corresponding direction.

In the stage light with the speed reducer (500) according to the present invention, the pivot shaft (400) of the light head (100) and/or the pivot shaft (400) of the supporting arm (200) is connected to the drive shaft (610) of the driving mechanism (600) by the speed reducer (500), thereby realizing using a transmission part in the speed reducer (500) for transmission, avoiding using a synchronous belt. The transmission part will not deform and cause inaccurate scanning positioning or fracture, and the product performance is more stable.

In a preferred embodiment of the present invention, the drive shaft (610) is arranged perpendicular to the pivot shaft (400). On the premise of ensuring that the drive shaft (610) is perpendicular to the pivot shaft (400), the driving mechanism (600) may be arranged at any position around the pivot shaft (400). It is specifically determined according to a space size of the installation location of the speed reducer (500), and one can choose freely to arrange the space reasonably. Optionally, the pivot shaft (400) of the light head (100) and the pivot shaft (400) of the supporting arm (200) are located on a common plane and are perpendicular to each other, and the drive shaft (610) is perpendicular to the common plane.

In a preferred embodiment of the present invention, the speed reducer (500) is connected to the pivot shaft (400) by a coupling flange (700). The coupling flange (700) can connect the ordinary rotary shaft (510) and the ordinary pivot shaft (400) without special design of the rotary shaft (510) of the speed reducer (500) and the pivot shaft (400), so the versatility of the components is stronger. One can choose the shape of the coupling flange (700) freely as needed, as long as the rotary shaft (510) and the pivot shaft (400) can be connected for transmission.

In a preferred embodiment of the present invention, the coupling flange (700) includes a stationary wheel (711) connected to the pivot shaft (400) and a stationary cylinder (712) connected to the rotary shaft (510) of the speed reducer (500). The stationary wheel (711) is located at an end portion of the stationary cylinder (712). The stationary wheel (711) is provided with a locking hole (713) in a direction perpendicular to the wheel, and the stationary cylinder (712) is provided with a locking hole (713) in a direction perpendicular to a center line thereof. Thereby, the stationary wheel (711) is connected to the pivot shaft (400) by screws, and the rotary shaft (510) is connected to the stationary cylinder (712) by screws, respectively. Since the pivot shaft (400) is generally larger in diameter, and the rotary shaft (510) of the speed reducer (500) is smaller, the coupling flange (700) is designed as a structure of the stationary wheel (711) and the stationary cylinder (712), which can solve the problem of the size mismatch between the pivot shaft (400) and the rotary shaft (510) to smoothly connect the two.

In a preferred embodiment of the present invention, it further includes a supporting frame (520) which supports the speed reducer (500). The speed reducer (500) is installed on the supporting frame (520). The supporting frame (520) is fixed to the light head (100) or the supporting arm (200) to facilitate fixing the speed reducer (500). Preferably, the supporting frame (520) is in a shape of a U-shaped plate, both side plates are used to be connected to the supporting arm (200), and a top plate is used to install the speed reducer (500).

In a preferred embodiment of the present invention, the speed reducer (500) is a gear reducer. That is, the transmission parts inside the speed reducer (500) are all gears. In other embodiment, the speed reducer (500) can also be a worm reducer and planetary reducer and a speed reducer that is a combination of the gear reducer, the worm reducer and the planetary reducer.

It should be noted that, between the speed reducer (500) and the drive shaft (610) of the driving mechanism (600) or the pivot shaft (400), a synchronous belt may be used for transmission appropriately, to meet various specific application requirements at the expense of a certain degree of accuracy. When necessary, a synchronous belt can also be arranged inside the speed reducer (500).

In a preferred embodiment of the present invention, the driving mechanism (600) of the light head (100) and the driving mechanism (600) of the supporting arm (200) are both located in the supporting arm (200). The space inside the light head (100) and the bottom box (300) is clear to facilitate installation of other components or heat dissipation.

In other embodiment, the driving mechanism (600) of the light head (100) is located in the light head (100), and the driving mechanism (600) of the supporting arm (200) is located in the bottom box (300). The space inside the supporting arm (200) is clear to facilitate installation of other components or heat dissipation.

Figure 2:
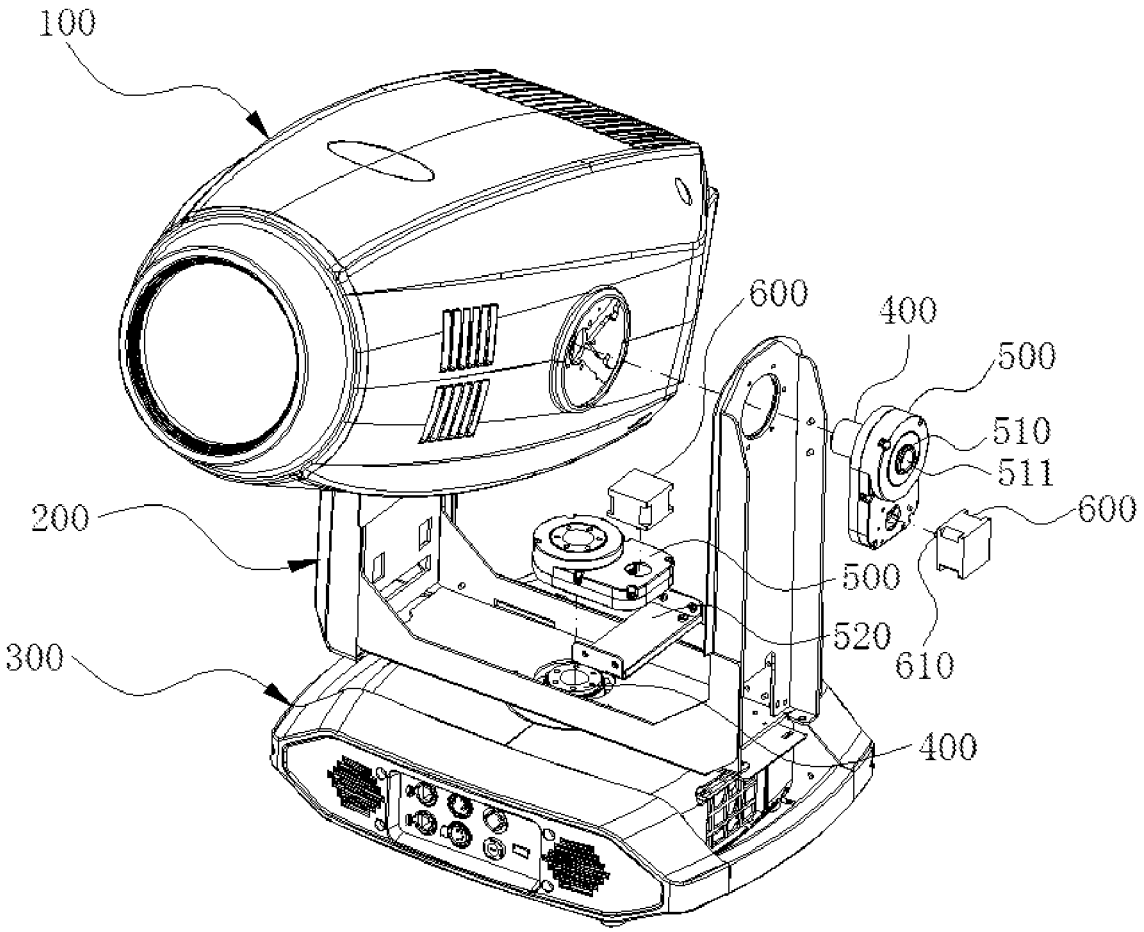
FIG. 2 is a structural schematic diagram of a stage light with a speed reducer according to the second embodiment of the present invention.

As shown in FIG. 2, the second embodiment of the present invention provides a stage light with a speed reducer (500), which includes a light head (100), a supporting arm (200) and a bottom box (300). The light head (100) is pivotally connected to the supporting arm (200) by a pivot shaft (400). The supporting arm (200) is pivotally connected to the bottom box (300) by a pivot shaft (400). The light head (100) rotates around a first direction on the supporting arm (200). The supporting arm (200) rotates to drive the light head (100) to rotate around a second direction. The pivot shaft (400) of the light head (100) and/or the pivot shaft (400) of the supporting arm (200) is connected to the drive shaft (610) of the driving mechanism (600) by the speed reducer (500). It can be that only one of the pivot shafts (400) is connected to the drive shaft (610) of the driving mechanism (600) by the speed reducer (500), or can be that the pivot shaft (400) of the light head (100) and the pivot shaft (400) of the supporting arm (200) are connected to the drive shaft (610) of the driving mechanism (600) by the speed reducer (500), to improve the rotation accuracy and stability of the light head (100) in the corresponding direction.

In a preferred embodiment of the present invention, the drive shaft (610) is arranged parallel to the pivot shaft (400). The driving mechanism (600) may either be located at a side of the speed reducer (500) close to the pivot shaft (400), or be located at a side of the speed reducer (500) far away from the pivot shaft (400), as long as the drive shaft (610) is arranged parallel to the pivot shaft (400). It is specifically determined according to a space size of the installation location of the speed reducer (500), and one can choose freely to arrange the space reasonably. Preferably, the driving mechanism (600) may be located at the side of the speed reducer (500) far away from the pivot shaft (400).

In a preferred embodiment of the present invention, the pivot shaft (400) has a through hole (410) for threading or circulating a cooling medium along a length direction. The speed reducer (500) and the rotating shaft (510) connected with the pivot shaft (400) are provided with corresponding perforation (511). By providing the through hole (410) and the perforation (511), it is convenient for cables and the cooling medium in the light head (100) and/or the supporting arm (200) to pass through, so that the light head (100) and/or the supporting arm (200) can be rotated smoothly. Optionally, a center line of the pivot shaft (400) and a center line of the through hole (410) overlap. Optionally, the pivot shaft (400) and the through hole (410) are both round holes.

In a preferred embodiment of the present invention, the pivot shaft (400) is connected to the rotary shaft (510) of the speed reducer (500) as a whole body. That is, the rotary shaft (510) of the speed reducer (500) is directly used as the pivot shaft (400) of the light head (100) and/or the pivot shaft (400) of the supporting arm (200), which omits the coupling flange (700) and has a simpler structure. Optionally, the pivot shaft (400) and the rotary shaft (510) of the speed reducer (500) which are connected as the whole body both penetrates along the length direction, to facilitate cables and the cooling medium in the light head (100) and/or the supporting arm (200) to pass through.

Figure 3:
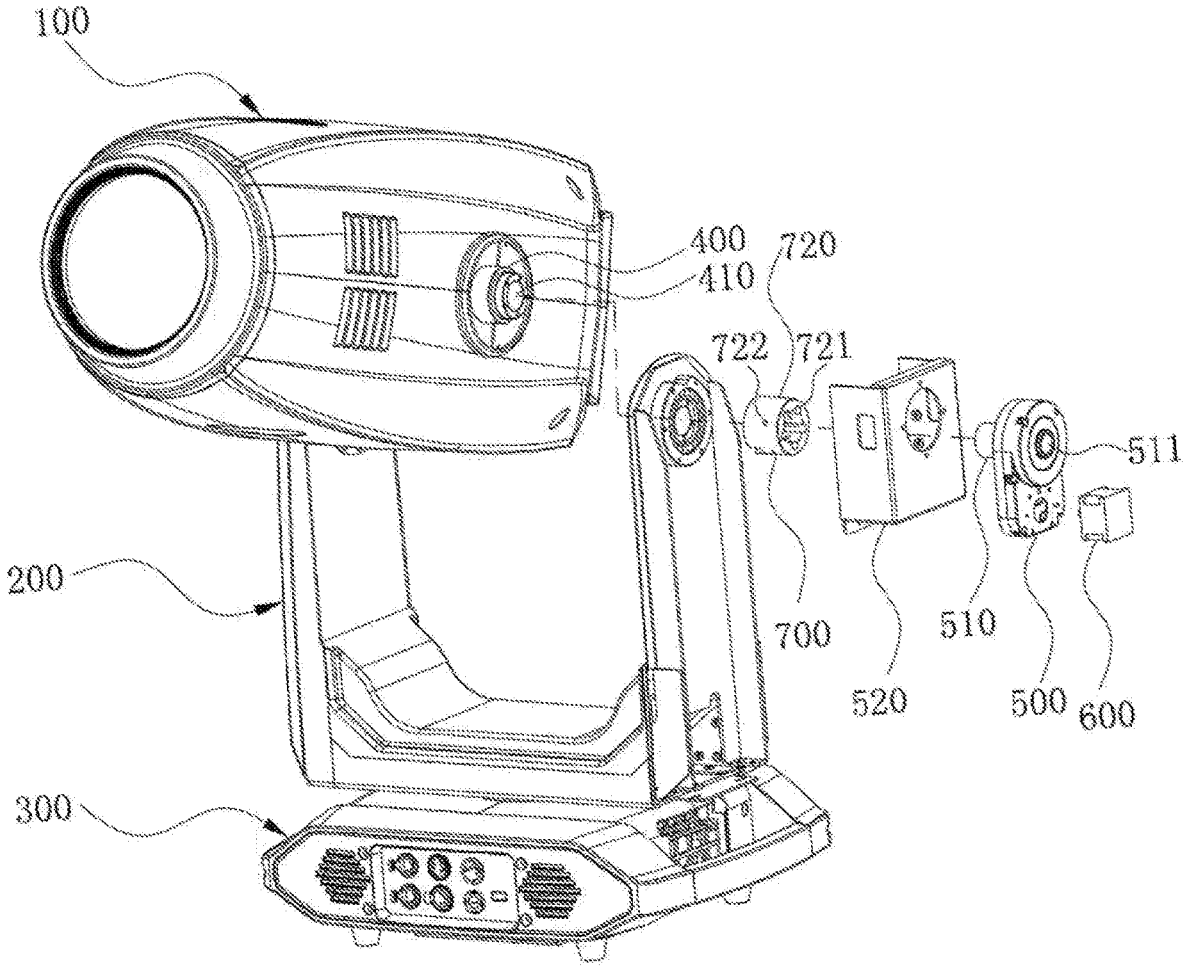
FIG. 3 is a structural schematic diagram of a stage light with a speed reducer according to the third embodiment of the present invention.

As shown in FIG. 3, the differences between the third embodiment of the present invention and the first embodiments are as follows. The coupling flange (700) includes a connecting cylinder (720). A side wall of the connecting cylinder (720) is provided with a first connecting hole (721) along a length direction to be connected and fixed with the pivot shaft (400) by screws. The side wall of the connecting cylinder (720) is provided with a second connecting hole (722) in a direction perpendicular to the length direction to be connected and fixed with the rotary shaft (510) of the speed reducer (500) by screws. When a diameter of the rotary shaft (510) and a diameter of the pivot shaft (400) are the same or similar, especially when a perforation (511) needs to be provided on the rotary shaft (510) of the speed reducer (500), the rotary shaft (510) and the pivot shaft (400) can be directly connected by the connecting cylinder (720), and the coupling flange (700) can be guaranteed to have a small volume.

In a preferred embodiment of the present invention, the drive shaft (610) is arranged parallel to the pivot shaft (400). The driving mechanism (600) may either be located at a side of the speed reducer (500) close to the pivot shaft (400), or be located at a side of the speed reducer (500) far away from the pivot shaft (400), as long as the drive shaft (610) is arranged parallel to the pivot shaft (400). It is specifically determined according to a space size of the installation location of the speed reducer (500), and one can choose freely to arrange the space reasonably. Preferably, the driving mechanism (600) may be located at the side of the speed reducer (500) far away from the pivot shaft (400).

In a preferred embodiment of the present invention, the pivot shaft (400) is provided with a through hole (410) for threading or circulating a cooling medium along a length direction. A rotary shaft (510) by which the speed reducer (500) is connected to the pivot shaft (400) is correspondingly provided with a perforation (511). By providing the through hole (410) and the perforation (511), it is convenient for cables and the cooling medium in the light head (100) and/or the supporting arm (200) to pass through, so that the light head (100) and/or the supporting arm (200) can be rotated smoothly. Optionally, a center line of the pivot shaft (400) and a center line of the through hole (410) overlap. Optionally, the pivot shaft (400) and the through hole (410) are both round holes.

Obviously, the above-mentioned embodiments of the present invention are only examples to clearly illustrate the present invention, and are not intended to limit the implementation of the present invention. For those ordinarily skilled in the art, other changes or variations in different forms can be made on the basis of the above description. It is not necessary and cannot be an exhaustive list of all implementations herein. Any modification, equivalent replacement and improvement made within the spirit and principle of the present invention shall be included in the scope of protection claimed by the present invention.

What is claimed is:

1. A stage light with one or two speed reducers (500) which comprise a first speed reducer and a second speed reducer, comprising: a light head (100), a supporting arm (200) and a bottom box (300), wherein the light head (100) is pivotally connected to the supporting arm (200) by a first pivot shaft (400), the supporting arm (200) is pivotally connected to the bottom box (300) by a second pivot shaft (400), the first pivot shaft (400) is connected to a first drive shaft of a first driving mechanism (600) by the first speed reducer (500) correspondingly, and/or the second pivot shaft (400) is connected to a second drive shaft of a second driving mechanism (600) by the second speed reducer (500) correspondingly;

wherein the pivot shaft (400) has a through hole (410) for threading or circulating a cooling medium along a length direction, the speed reducer (500) and a corresponding rotary shaft (510) of the speed reducer connected with the corresponding pivot shaft (400) are provided with corresponding perforation (511);

wherein the first speed reducers (500) is connected to the first pivot shafts (400) by a first coupling flanges (700), and/or the second speed reducer (500) is connected to the second pivot shaft (400) by a second coupling flange (700):

the coupling flanges (700) comprises a stationary wheel (711) connected to the corresponding pivot shafts (400), and a stationary cylinder (712), connected to the corresponding rotary shaft (510) of the speed reducer (500), and the stationary wheel (711) is located at an end portion of the corresponding stationary cylinder (712); or the coupling flange (700) comprises a connecting cylinder (720), a side wall of the connecting cylinder (720) is provided with a first connecting hole (721) along a length direction to be connected and fixed with the corresponding pivot shaft (400) by screws, and the side wall of the connecting cylinder (720) is provided with a second connecting hole (722) in a direction perpendicular to the length direction to be connected and fixed with the corresponding rotary shaft (510) of the speed reducer (500) by screws; and wherein the first and the second speed reducers (500) are a gear reducer.

2. The stage light with the one or two speed reducers (500) according to claim 1, wherein the first and second drive shafts (610) are arranged parallel or perpendicular to the first and second pivot shafts (400), respectively.

3. The stage light with the one or two speed reducers (500) according to claim 1, further comprising: a first and a second supporting frames (520) which supports the first and the second speed reducers (500), respectively.

4. The stage light with the one or two speed reducers (500) according to claim 1, wherein the first driving mechanism (600) of the light head (100) and the second driving mechanism (600) of the supporting arm (200) are both located in the supporting arm (200).

5. The stage light with the one or two speed reducers (500) according to claim 1, wherein the first driving mechanism (600) of the light head (100) is located in the light head (100), and the driving mechanism (600) of the supporting arm (200) is located in the bottom box (300).

* * * * *